US007414370B2

(12) United States Patent
Kunjappan

(10) Patent No.: US 7,414,370 B2
(45) Date of Patent: Aug. 19, 2008

(54) INCREASING RELIABILITY OF OPERATION OF LIGHT EMITTING DIODE ARRAYS AT HIGHER OPERATING TEMPERATURES AND ITS USE IN THE LAMPS OF AUTOMOBILES

(75) Inventor: Shanoprasad Kunjappan, Bangalore (IN)

(73) Assignee: Honeywell International Inc., Morristown, NJ (US)

( * ) Notice: Subject to any disclaimer, the term of this patent is extended or adjusted under 35 U.S.C. 154(b) by 197 days.

(21) Appl. No.: 11/307,371

(22) Filed: Feb. 3, 2006

(65) Prior Publication Data

US 2007/0182337 A1 Aug. 9, 2007

(51) Int. Cl.
*H05P 37/00* (2006.01)

(52) U.S. Cl. ..... 315/241 S; 315/241 P; 315/247; 315/312; 315/309

(58) Field of Classification Search ..... 315/82, 315/83, 77, 247, 246, 225, 224, 241 S, 241 P, 315/149–159, 312, 309
See application file for complete search history.

(56) References Cited

U.S. PATENT DOCUMENTS 5,765,940 A 6/1998 Levy et al.
6,351,079 B1 2/2002 Willis
2004/0142705 A1* 7/2004 Casebolt et al. ..... 455/456.1
2004/0212310 A1* 10/2004 Ito et al. ..... 315/77
2005/0057179 A1 3/2005 Madhani et al.
2005/0196721 A1 9/2005 Jackson, III et al.
2005/0243041 A1 11/2005 Vinn
2005/0259091 A1 11/2005 Sakamoto
2005/0265709 A1 12/2005 Kim et al.
2005/0275711 A1 12/2005 Liu et al.

FOREIGN PATENT DOCUMENTS

EP 1079667 A2 2/2001
EP 1278402 A1 1/2003
WO WO 01/48495 A1 7/2001

* cited by examiner

*Primary Examiner*—Tuyet Vo
(74) *Attorney, Agent, or Firm*—Naren Thappeta

(57) ABSTRACT

A lamp in which a LED array is coupled to a transistor such that the same amount of current flows through both. The voltage level at the control (e.g., base) terminal of the transistor is controlled such that the current magnitude is reduced when the operating temperature rises. As a result, the heat generated from the junctions of the LEDs in the LED arrays is reduced, thereby compensating for the increase in the operating temperature.

12 Claims, 4 Drawing Sheets

Column 1 → Column 2 →

| Ambient Temperature (degrees C) | LED Current (mA) |
|---|---|
| - 40 | 60.2 |
| - 30 | 60.2 |
| - 20 | 59.8 |
| - 10 | 59.2 |
| 0 | 58.8 |
| 10 | 58.4 |
| 20 | 58 |
| 30 | 57.6 |
| 40 | 56.8 |
| 50 | 56 |
| 60 | 54.6 |

FIG. 3

INCREASING RELIABILITY OF OPERATION OF LIGHT EMITTING DIODE ARRAYS AT HIGHER OPERATING TEMPERATURES AND ITS USE IN THE LAMPS OF AUTOMOBILES

BACKGROUND OF THE INVENTION

1. Field of the Invention

The present invention generally relates to Light Emitting Diode (LED) arrays, and more specifically to a method and apparatus for increasing reliability of operation of the LED arrays in lamps operating at higher temperatures. The invention also relates to the use of such lamps as brake/tail lamps of an automobile.

2. Related Art

A light emitting diode (LED) commonly contains a semiconductor p-n junction, and produces light with an intensity directly proportional to an electric current flowing through it in the forward direction. Many of such LEDs are often formed as an array, commonly to generate light of a desired level of intensity.

LED arrays may in turn be packaged as lamps along with other components such as driver circuits and casings. One such application is the use of LED array based lamps as brake and tail lamps in automobiles. In general, the brake light generates light of one intensity in response to brake being applied, and a tail lamp generates light of another intensity especially during night.

One problem with LED array based lamps is that the LED arrays may be susceptible to failures at high operating temperatures (i.e., in the general surroundings of the light or automobile). The source of such failures is often that the operating temperature may cause an increase in the temperature of P-N junctions in the LEDs, thereby further increasing the temperature in the immediate viscinity of the LED arrays, which could destroy/burn the LED material (including the P-N junction, casing, or wire-bonding of the PN junction to connecting leads).

What is therefore needed is a method and apparatus for increasing the reliability of operation of the LED arrays in lamps operating at higher temperatures.

BRIEF DESCRIPTION OF THE DRAWINGS

The present invention will be described with reference to the accompanying drawings, which are described below briefly.

FIG. 3 is a table containing the values of forward current through an LED array for various values of ambient/operating temperature in one embodiment.

In the drawings, like reference numbers generally indicate identical, functionally similar, and/or structurally similar elements. The drawing in which an element first appears is indicated by the leftmost digit(s) in the corresponding reference number.

DETAILED DESCRIPTION

1. Overview

A lamp provided according to an aspect of the present invention contains a transistor passing a current of a magnitude determined by a voltage at a control terminal, and an LED array generating light with an intensity proportionate to the magnitude of the current. A driver block then controls the voltage level at the control terminal such that the current magnitude is reduced when the operating temperature rises. As a result, the heat generated by the LED array reduces when the operating temperature rises, thereby avoiding problems such as damage to the LEDs or other components of the lamp.

Such a lamp is adapted for use as brake/tail lamp of an automobile according to another aspect of the present invention.

Several aspects of the invention are described below with reference to examples for illustration. It should be understood that numerous specific details, relationships, and methods are set forth to provide a full understanding of the invention. One skilled in the relevant art, however, will readily recognize that the invention can be practiced without one or more of the specific details, or with other methods, etc. In other instances, well_known structures or operations are not shown in detail to avoid obscuring the invention.

2. Lamp

Figure 1:
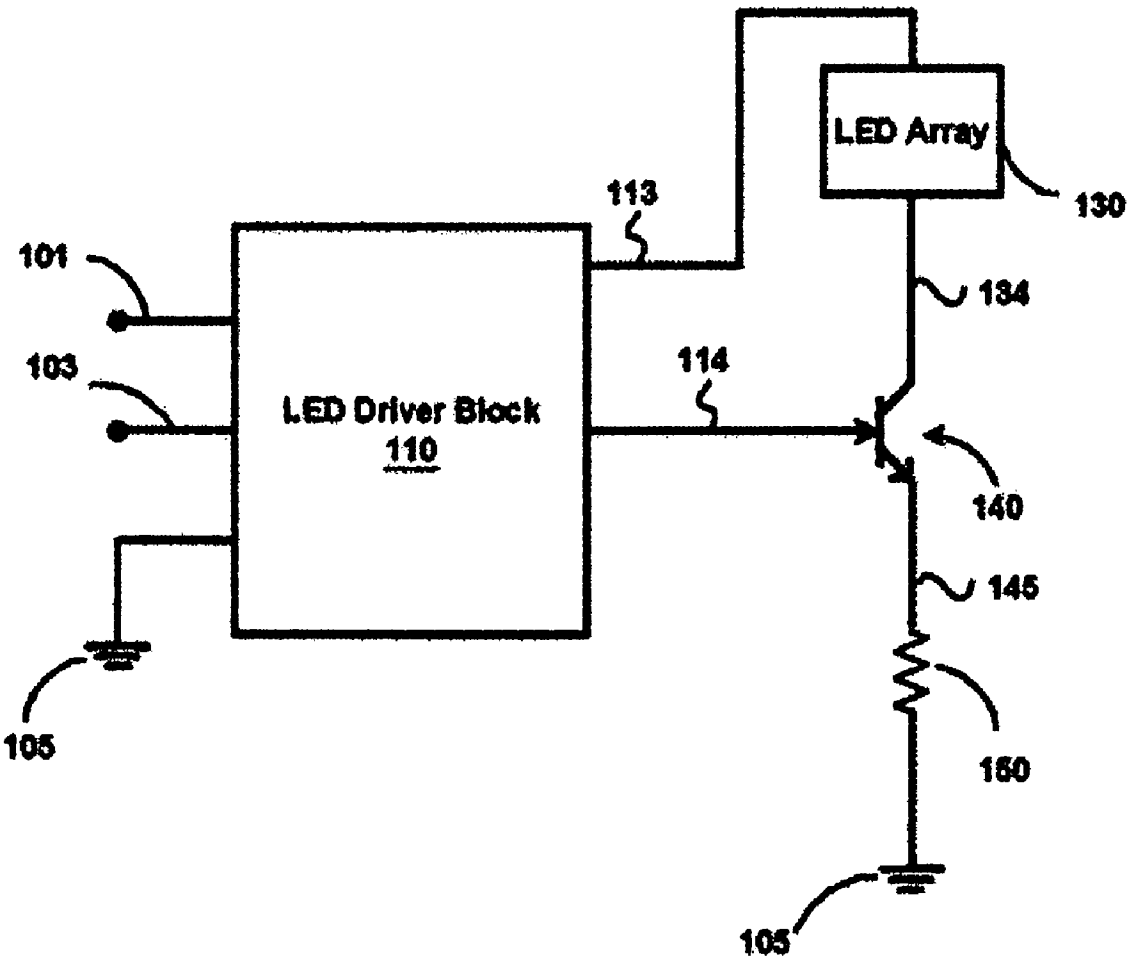
FIG. 1 is a block diagram illustrating the details of a portion of a lamp according to an aspect of the present invention.

FIG. 1 is a block diagram illustrating the details of a portion of a lamp according to an aspect of the present invention. The diagram is shown containing LED array 130, transistor 140, resistor (Re)150 and LED driver block 110. Each element is described in further detail below.

For ease of description, FIG. 1 is shown containing only one LED array and associated transistor 140 and resistor 150. Automotive lighting applications typically use multiple LED arrays (similar to LED array 130) and associated transistors and resistors. LED driver block 110 may then provide the signals described below to each of such LED arrays.

LED array 130 may contain one or more LEDs connected in series and powered by voltage on path 113. The intensity of light emitted by LED array 130 would be proportionate to the current passing through the array (and seen on path 134). With respect to implementation as a tail lamp in an automobile described below, the currents are controlled to generate a higher light intensity when a brake is applied (as indicated by path 101) and a lower intensity when the lamp is to operate as a tail lamp (as indicated by path 103).

Transistor 140 is shown as a BJT (bipolar junction transistor) containing base terminal (connected to path 114), emitter terminal (connected to path 145) and collector terminal (connected to path 134). Transistor 140 is in an ON state when the voltage on path 114 exceeds a pre-determined threshold, and is in an OFF state otherwise.

The magnitude of the current flowing through transistor 140 (and thus LED array 130) is also set by the voltage level on path 114, and the resistance offered by resistor 150. Resistor 150 is used to set a required value of base current (on path 145), and consequently LED current (on path 134). Assuming the resistance is fixed, by increasing the voltage on path 114, the current also can be increased.

LED driver block 110 controls the voltage level on path 114 to turn on/off the light, and also to obtain a desired light intensity from LED array 130. The voltage level on path 114 is controlled such that the voltage level is lowered at higher operating temperatures. As a consequence, LED current on path 134 reduces correspondingly, thereby reducing the junction temperature of the LEDs in LED array 130.

With respect to use in automotive applications, when path 101 indicates that brake is applied, a high voltage is applied on path 114 and a low voltage (but sufficiently high to turn transistor 140 on) is applied on path 114 when the lamp needs to operate merely as a tail light as indicated by path 103. Even when applying the high voltage corresponding to brake light, the voltage level on path 114 (and thus the current on path 134) is reduced, potentially proportionate to operating temperatures.

The description is continued with respect to the manner in which such compensation for temperature can be attained according to an aspect of the present invention. The description is then continued with a circuit level implementation of LED driver block 110 in one embodiment.

3. Temperature Compensation

Figure 2:
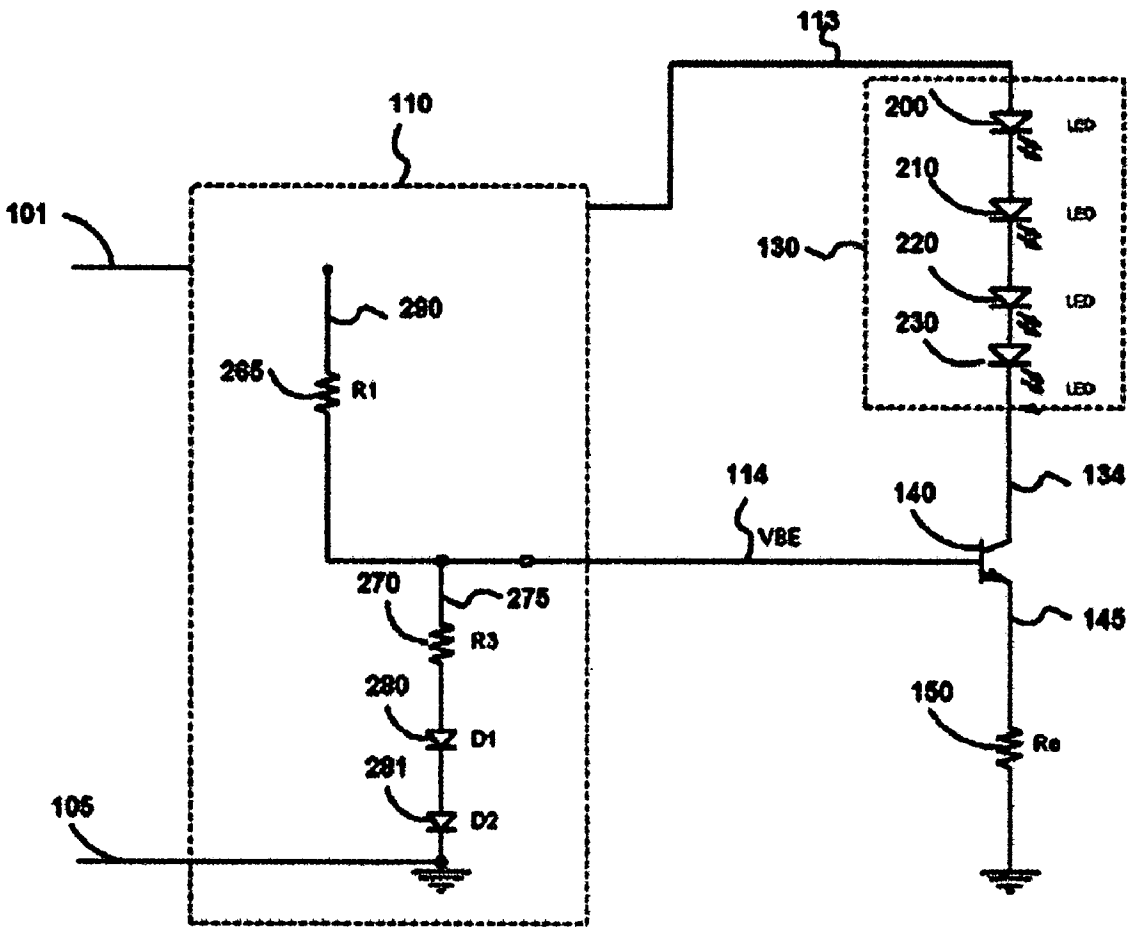
FIG. 2 is a circuit-level diagram illustrating the manner in which temperature compensation is provided according to an aspect of the present invention.

FIG. 2 is a circuit-level diagram illustrating the manner in which temperature compensation is provided according to an aspect of the present invention. The diagram is shown containing resistors (R1)265 and (R3)270, and diodes(D1) 280 and (D2)281 within LED driver block 110. Some of the components of FIG. 1 are also repeated and used in the analysis below. The components in LED driver block 110 operate to reduce the voltage on path 114 in response to an increase in operating temperature, thereby reducing the current in the LED array 130 of FIG. 1, as described below.

Resistors R1, R2 and diodes D1 and D2 form a voltage divider network which receives a voltage (which may be derived from voltage indicating a "brake operation" on path 101 indicating, as described below with respect to FIG. 3) on path 290, and provides a desired level of voltage on path 114, as described below.

Diodes D1 and D2 operate to provide temperature compensation to LED current on path 134. This may be appreciated by observing from FIG. 2 that the voltage provided on path 114 is equal to the sum of voltage drops across resistor R3, diode D1 and diode D2. Each of voltage drops across diodes D1 and D2 is inversely proportional to operating temperature of the circuit of FIG. 2. Thus, as temperature varies, the voltage drops across diodes D1 and D2 changes inversely (or by negative correlation) by a corresponding value, thereby changing the voltage provided on path 114.

For example, an increase in operating temperature may cause junction temperatures of LEDs in LED array 130 to increase. However, such an increase in operating temperature causes a corresponding (and potentially proportional) decrease in voltage drops across diodes D1 and D2, thereby decreasing the voltage provided on path 114. Consequently, LED current on path 134 decreases correspondingly, the power dissipation in LED array 130 reduces and the junction temperature of LEDs in LED array 130 is maintained to lie within acceptable limits.

The operation of the circuit of FIG. 2 is described in further detail below with respect to an example design specification for illustration.

4. Illustration with an Example Design Specification

For illustration it is assumed that a lamp is to be designed with the following design specification:

1. Operating temperature range for the circuit of FIG. 2 to be −40 degrees celcius (C.) to +85 C.

2. Maximum operating junction temperature (Tj) for each of LEDs 200, 210, 220 and 230-230 to be 125 degrees C.

Circuit functioning is described below to show that required temperature compensation is provided to meet the example specification above. It is assumed that LEDs 200, 210, 220 and 230 are used in a brake lamp of an automobile, and that a current of 65 milliAmperes through LEDs 200-230 is required for a corresponding level of light intensity. The following are also assumed: Rated Maximum forward current for each of LEDs 200-230=70 milliAmperes (mA).

Operating forward current through each of LEDs 200-230=65 mA.

Forward voltage drop at 65 mA across each of LEDs 200-230=2.1Volts(V)

Minimum voltage on path 113=10.5V

Constant voltages of appropriate required value are available on paths 101 and 103.

The computations below are shown with respect to LED 200 for illustration. (Assuming LEDs 200-230 have identical characteristics, the computations below would apply also to LEDs 210-230).

operating forward current (emitter current Ie on path 134)=65 mA — Equation 1

Forward voltage drop (Vf) across LED 200=2.10V — Equation 2

From equations 1 and 2:

$$\text{Power dissipation } (Pd) = Vf \times IE \quad \text{Equation 3}$$
$$= 2.1 \times 0.065$$
$$= 0.136\text{W}$$

Thermal resistance (Rj) of casing (not shown) of

LED 200=325 degrees C./W — Equation 4

From equations 3 and 4:

$$\text{Increase in junction temperature (DELTA}(T)\text{) of LED 200} = Pd \times Rj \quad \text{Equation 5}$$
$$= 0.136 \times 325$$
$$= 44.2 \text{ degrees C.}$$

Therefore for the maximum ambient operating temperature (Ta) of 85 C, Tj is given by:

$$Tj = Ta + \text{DELTA}(T) \quad \text{Equation 6}$$
$$= 129.2 \text{ degrees C.}$$

It may be seen from equation 6 that the junction temperature Tj exceeds the permitted maximum of 125 degrees C.

It is now shown that the operation of diodes 280/281 effectively compensates for an increase in ambient temperature Ta, and maintains the junction temperature Tj of LED 200 within acceptable limits (maximum of 125 degrees C., as per example specification).

Application of brakes would cause a constant voltage Vb to be present on path 101. Path 103 is assumed not to be connected to any voltage.

Therefore, voltage (Vbe) on path 114 is given by $$Vbe = VD1 + VD2 + (R1 \times I_B) \quad \text{Equation 7}$$

wherein:

VD1 is the voltage drop across diode D1.

VD2 is the voltage drop across diode D2.

R1 is the resistance of R1(270).

$I_B$ is the current through the series path (275) containing R1, D1 and D2.

It has been assumed that a constant voltage is available on path 113. Therefore the value of $I_B$ may be assumed to be remain substantially constant across required operating temperature range. Consequently, equation 7 may be written as:

$$Vbe=VD1+VD2+k1 \quad \text{Equation 8}$$

wherein k1 equals the term ($R1 \times I_B$)of equation 7.

As is well known, the forward voltage drop (such as VD1 and VD2 of equation 7) across a diode is given by the following equation:

$$\text{forward voltage drop } VD=(nkT/q)\ln(I_D/I_S) \quad \text{Equation 9}$$

wherein:

VD=Diode forward voltage, n=Diode emission coefficient, k=Boltzman constant

T=Temperature in degrees q=Charge of electron $I_D$=Diode forward current $I_S$=reverse saturation current of diode At low values of forward current the relationship between junction temperature (Tjd for diodes D1 and D2) and forward voltage VD (VD1 and VD2 in FIG. 2) is approximately linear, and hence a change in junction temperature produces a corresponding change by a factor K. This relation is given by:

$$\text{DELTA}(VD)=\text{DELTA}(Tjd)/K \quad \text{Equation 10a}$$

wherein:

DELTA (VD) is equal to a change in diode forward voltage

DELTA (Tjd) is equal to a (corresponding) change in junction temperature of the diode K is a proportionality factor (The units of K are in ° C./mV and the value is typically in the range of 0.4 to 0.8 C/mV). The equation can be simplified to our application as below Equation 10a may be written as:

$$\text{DELTA}(VD)=\text{DELTA}(Tj)\times K1 \quad \text{Equation 10b}$$

wherein: K1=1/K, and is typically in the range of 1.25 to 2.5 mV/C.

For a maximum operating temperature of 85 degree C. assumed in this example and an ambient temperature of 25 degrees C., change in diode junction temperature is given by:

$$\text{DELTA}(Tjd)=85-25=60 \text{ deg C.}$$

Assuming a minimum value of 1.25 mV/C for K1, change in diode forward voltage is given by:

$$\text{DELTA}(VD)=75 \text{ mV} \quad \text{Equation 11a}$$

Thus, for a change in ambient temperature from 25 degrees C. to 85 degrees C., the change in forward voltage drop across each of diodes D1 and D2 is 75 mV, and the total change in voltage drop across the series combination of diodes D1 and D2 is given by:

$$\text{DELTA}(VD1)+\text{DELTA}(VD)=150 \text{ mV} \quad \text{Equation 11b}$$

If path 114 were disconnected from LED driver block 110, voltage (Vbe) on path 114 is given by:

$$Vb\,e(\text{without the LED driver block 110})=(12\times0.065)+0.7=1.48 \text{ Volts} \quad \text{Equation 12}$$

wherein 12 ohms is the resistance of Re.

0.065 (65 mA earlier assumed operating forward current) is the current through Re 0.7 is the cut-in base-to-emitter voltage of transistor 140.

With LED driver block 110 connected to path 114, Vbe of equation 12 is reduce by 150 mV (equation 11b) and is given by:

$$Vbe(\text{with LED driver block 110 connected})=1.48-0.15=1.33\text{V} \quad \text{Equation 13}$$

Thus, the connection of diodes D1 and D2 has effectively reduced Vbe from 1.48V to 1.33V at an operating temperature of 85 degrees C.

Therefore the corresponding value of forward current (Ie) on path 134 (and 145, neglecting base current of transistor 140) is given by:

$$Ie=(1.33-0.7)/12=52.5 \text{ mA} \quad \text{Equation 14}$$

wherein:

1.33 is the value of Vbe computed in equation 13.

0.7 is the cut-in base-to-emitter voltage of transistor 140

12 ohms is the resistance of Re.

The corresponding value of change in junction temperature of LED 200 is therefore given by:

$$\begin{aligned}\text{DELTA}(Tj) &= Pd\times Rj \quad \text{Equation 15}\\ &= 0.052.5\times2.1\times325\\ &= 35.5 \text{ deg C.}\end{aligned}$$

wherein:

Pd is the power dissipated and is equal to 0.052 Amperes (52 mA computed in equation 14) multiplied by 2.1V (forward voltage drop across LED 200), and Rj is given in equation 4.

Thus, from equation 15, junction temperature Tj of LED 200 is given by:

$$\begin{aligned}Tj &= Ta+\text{DELTA}(Tj) \quad \text{Equation 16}\\ &= 85+35.35\\ &= 120.5 \text{ degrees C.}\end{aligned}$$

It may be seen from equation 16 that the junction temperature Tj of LED 200 is less than the maximum value of 125 degrees C. permitted by the design specification.

Thus, it has been shown that the variation in forward voltage drop across diodes D1 and D2 has effectively compensated for temperature and helped maintain junction temperature of LED 200 within acceptable limits. Junction temperatures of LEDs 210-230 will similarly be maintained within the acceptable limit by the operation of diodes D1 and D2 of LED driver block 110.

FIG. 3 is a table containing the values of forward current through LED array 130 for various values of ambient temperature. Column 1 lists ambient temperatures for which the corresponding forward currents are listed in column 2. It may be verified that the corresponding junction temperatures for the various values of forward current listed in column 2 lie within the acceptable limit required in this example.

It may also be desirable to have control on the intensity level of LEDs in LED array 130. For example, in an automobile, "brake" indication generally requires higher intensity than a "tail" light intensity. The LED driver block 110 of FIGS. 1 and 2 could incorporate features to facilitate intensity control of LEDs (for brake indication and tail light operation), while providing the temperature-compensation feature described above. Accordingly the description is continued to illustrate such a feature according to another aspect of the present invention.

5. LED Intensity Control to Provide Brake and Tail Indications

Figure 4:
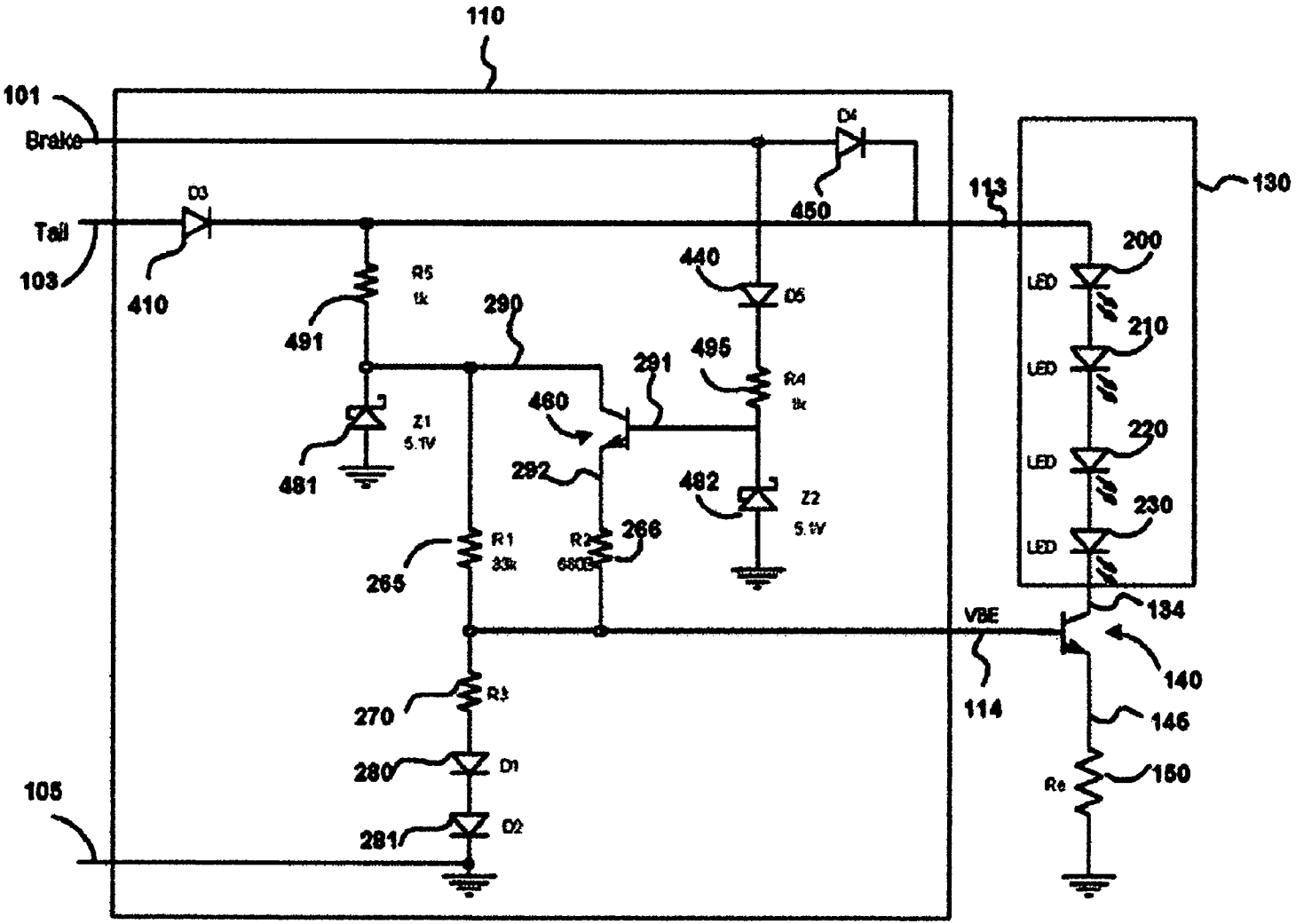
FIG. 4 is a circuit diagram of LED driver block 110 and associated LED array illustrating the manner in which different intensity levels of an LED array are provided in an embodiment of the present invention.

FIG. 4 is a circuit-level diagram of LED driver block 110 and associated LED array illustrating the manner in which different intensity levels of an LED array are provided in an embodiment of the present invention. The diagram is shown containing LED array 130, transistor 140, resistor (Re) 150 and LED driver block 110.

LED array 130 is shown containing LEDs 200, 210, 220 and 230, and LED driver block 110 is shown containing resistors (R1)265, (R2) 266, (R3)270, (R4) 495 and (R5) 491, diodes (D1) 280, (D2)281, (D3) 410, (D4) 450, and (D5) 440, resistors zener diodes (Z1) 481 and (Z2) 482, and transistor 460. The remaining components of FIG. 1 are repeated for ease of description.

Resistors R1, R2 and diodes D1 and D2 form a voltage divider network which receives a voltage on path 290, and provide a desired level of voltage on path 114 to obtain a corresponding desired level of intensity from LED array 130, as noted above. Resistors R5 and R4 are current-limiting resistors. Diode D5 is used to prevent damage to zener diode Z2 in the event the voltage between brake (101) and ground (105) is negative. Diodes D1 and D2 operate to provide temperature compensation to LED current on path 134 as described above, and the description is not repeated here for the sake of conceiseness.

Voltages indicating a "brake" operation and a "tail lamp ON" operation are provided externally on paths 101 and 103 respectively, and generally are provided by a same source. Diode D3 blocks a voltage provided on path 101 from appearing on path 103. Similarly, diode D4 blocks a voltage provided on path 103 from appearing on path 101. Thus diodes D3 and D4 provide protection to voltage sources providing corresponding "brake" and "tail lamp ON" voltages on paths 101 and 103 respectively. Voltage on path 112 for supplying current to LED array 130 is equal to the greater of the voltages on paths 101 and 103 minus diode drop due to D4 or D3. In the example embodiment of FIG. 4, voltages on path 101 and 103 are equal, and chosen to be 14 V.

Zener diode Z1 has a breakdown voltage of 5.1 Volts (V). Thus, when voltage on path 103 is greater than 5.1V plus diode drop (typically 0.7V)due to D3, the operation of Z1 causes a voltage of 5.1V to be present on path 290. Similarly, zener diode Z2 has a breakdown voltage of 5.1 Volts (V). Thus, when voltage on path 101 is greater than 5.1V plus diode drop (typically 0.7V)due to D5, the operation of Z2 causes a voltage of 5.1V to be present on path 291.

Transistor 460 is shown as a BJT (bipolar junction transistor) containing base (control) terminal (connected to path 291), emitter terminal (connected to path 292) and collector terminal (connected to path 290). The emitter terminal and the collector terminal form a pair of terminals between which a current path would be present. Transistor 460 is in an ON state when the voltage on path 101 exceeds 5.1V plus diode drop (typically 0.7V)due to D5, and is in an OFF state otherwise.

The operation of the circuit of FIG. 4 is now described to illustrate obtaining one (high) intensity level of LED array 130 corresponding to when brake is applied (i.e. a corresponding voltage is present on path 101), and a second (low) intensity level of LED array 130 corresponding to when only tail lamp functioning is required (i.e. a corresponding voltage is present on path 103, and no voltage is present on path 101).

Tail Light On Operation:

Transistor 460 is in the OFF condition, as there would be no voltage on path 101. When a required value of voltage (to indicate tail light ON condition) is present on path 103 (Tail), zener diode Z1 operates in the breakdown region, and 5.1 V is present on path 290.

R1, R3, D1 and D2 form a voltage divider network. Therefore for a voltage of 5.1V on path 290, the value of voltage on path 114 is given by:

$$Vbe=[(5.1-0.78)\times(33/33033)]+0.78 \text{ volts} \qquad \text{Equation 17}$$

wherein:

Vbe is the voltage on path 114.

5.1V is the voltage on path 290.

33 is the value of resistance of resistor R3.

33000 is the value of resistance of resistor R1.

0.78V is the sum of diode drops (assumed to be 0.39V) due to each of D1 and D2.

From equation 17, Vbe (for tail light ON) is approximately equal to 1.3V.

Therefore, the value of emitter current (path 145) and consequently LED current (path 134) is given by:

$$\text{LED current}=(0.78-0.7)/12 \text{ (approximately)}=6.66 \text{ mA} \qquad \text{Equation 18.}$$

Thus an intensity corresponding to 6.66 mA is provided by LED array 130.

Brake Light Operation:

A required value of voltage(indicating brake operation) is applied on path 101. Hence, zener diode Z2 operates in the breakdown region, and 5.1 V is present on path 291,thereby turning transistor 460 ON.

Thus, resitor R2 is connected to path 290. This effectively casuses resistors R1 and R2 to be connected in parallel. Since value of R2 (assumed in this example )680 ohm is much smaller than the value of R1 (33000 ohms), the effective parallel resistance of R1 and R2 may be approximated by a value of R2, i.e. 680 ohms, and the effect of resitor R1 may be removed from the calculations given below.

R2, R3, D1 and D2 form a voltage divider network. Therefore for a voltage of 5.1V on path 291, the value of voltage on path 114 is given by:

$$Vbe=[(5.1-1.3)\times(33/713)]+1.3 \text{ volts} \qquad \text{Equation 19}$$

wherein:

Vbe is the voltage on path 114.

5.1V is the voltage on path 290.

33 ohms is the value of resistance of resistor R3.

713 ohms is the sum of resistances R2 (680 ohms) and R3 (33 ohms).

1.3V is the sum of voltage drops (assumed to be 0.39V due to each of D1 and D2) plus 0.52V drop due to the base-emitter junction of BJT 460.

From equation 19, Vbe (for brake light operation) is approximately equal to 1.48V Therefore, the value of emitter current (path 145) and consequently LED current (path 134) is given by:

$$\text{LED current} = (1.48 - 0.7)/12 \text{ (approximately)} \qquad \text{Equation 20}$$

$$= 65 \text{ mA.}$$

Thus, a greater light intensity corresponding to 65 mA is provided by LED array 130.

It has thus been shown that the LED driver block enables LED array 130 to provide two intensity levels, a lower level for a tail light operation, and a higher intensity for a brake operation.

6. CONCLUSION

While various embodiments of the present invention have been described above, it should be understood that they have been presented by way of example only, and not limitation. Thus, the breadth and scope of the present invention should not be limited by any of the above described exemplary embodiments, but should be defined only in accordance with the following claims and their equivalents.

What is claimed is:

1. A lamp comprising:

a transistor having a control terminal, said transistor passing a current of a magnitude determined by a voltage at said control terminal;

a LED array coupled to said transistor, and generating light with an intensity proportionate to said magnitude of said current; and a driver block coupled to said control terminal, wherein said driver block comprises at least one component having a cross voltage which has a negative correlation with said operating temperature, wherein said voltage is derived across said component to generate said voltage with a first level in response to an operating temperature of said lamp being equal to a first value, and with a second level in response to said operating temperature of said lamp being equal to a second value, wherein said first value is not equal to said second value and said first level is not equal to said second level such that said LED array generates light with a different intensity in response to said operating temperature of said lamp being at said first value compared to when said operating temperature of said lamp being at said second value wherein said first value is more than said second value, and said first level causes said magnitude to be lesser compared to the magnitude caused by said second level, whereby LEDs in said LED array pass less current in response to an increase in said operating temperature.

2. The lamp of claim 1, wherein said LED array is coupled to said transistor such that the same magnitude of current passes through both of said transistor and said LED array.

3. The lamp of claim 1, wherein said at least one component comprises a diode.

4. The lamp of claim 1, wherein said transistor is turned on when said control terminal has a voltage which exceeds a pre-determined threshold and turned off otherwise.

5. The lamp of claim 1, wherein said lamp is used in an automobile, wherein said driver block receives a first signal indicating that a brake is being applied and a second signal indicating that a tail light is to be present, said driver block receiving said first signal and said second signal and generating said voltage with a third voltage level when said first signal indicates that said brake is applied and with a fourth voltage level when said second signal indicates that said tail light is to be present.

6. The lamp of claim 5, wherein said driver block comprises:

a first resistor, a second resistor and a third resistor;

a first transistor having a control terminal and a pair of terminals having a current channel in between;

a first constant voltage reference and a second constant voltage reference, wherein said second resistor and a combination of said first transistor and said third resistor are connected in parallel between a first node and a second node, wherein each of said first signal and said second signal is coupled to said first node, wherein a terminal of said first constant voltage reference is coupled to said first node, another terminal of said first constant voltage reference being coupled to a constant voltage level, wherein a terminal of said second constant voltage reference is coupled to said control terminal of said first transistor and said first signal, another terminal of said second constant voltage reference being coupled to a constant voltage level, wherein one of said pair of terminals of said first transistor is coupled to said first node, and the other one of said pair of terminals of said first transistor is coupled to said third resistor, wherein said first resistor is coupled between said second node and said at least one component.

7. The lamp of claim 6, wherein said at least one component comprises a diode and said first constant voltage reference comprises a zener diode.

8. A lamp comprising:

a transistor having a control terminal, said transistor passing a current of a magnitude determined by a voltage at said control terminal;

a LED array coupled to said transistor, and generating light with an intensity proportionate to said magnitude of said current;

a driver block coupled to said control terminal and generating said voltage with a first level when an operating temperature of said lamp equals a first value, and a with a second level when said operating temperature of said lamp equals a second value, wherein said first value is not equal to said second value and said first level is not equal to said second level, wherein said driver block comprises:

at least one component having a cross_voltage which has a negative correlation with said operating temperature, wherein said voltage is derived across said component;

a first resistor, a second resistor and a third resistor;

a first transistor having a control terminal and a pair of terminals having a current channel in between;

a first constant voltage reference and a second constant voltage reference, wherein said second resistor and a combination of said first transistor and said third resistor are connected in parallel between a first node and a second node, wherein each of said first signal and said second signal is coupled to said first node, wherein a terminal of said first constant voltage reference is coupled to said first node, another terminal of said first constant voltage reference being coupled to a constant voltage level, wherein a terminal of said second constant voltage reference is coupled to said control terminal of said first transistor and said first signal, another terminal of said second constant voltage reference being coupled to a constant voltage level, wherein one of said pair of terminals of said first transistor is coupled to said first node, and the other one of said pair of terminals of said first transistor is coupled to said third resistor, and wherein said first resistor is coupled between said second node and said at least one component, wherein said first value is more than said second value, and said first level causes said magnitude to be lesser compared to the magnitude caused by said second level, whereby LEDs in said LED array pass less current with an increase in operating temperature.

9. The lamp of claim 8, wherein said lamp is used in an automobile.

10. The lamp of claim 8, wherein said at least one component comprises a diode and said first constant voltage reference comprises a zener diode.

11. The lamp of claim 8, wherein said transistor is turned on when said control terminal has a voltage which exceeds a pre-determined threshold and turned off otherwise.

12. The lamp of claim 11, wherein said driver block receives a first signal indicating that a brake is being applied and a second signal indicating that a tail light is to be present, said driver block receiving said first signal and said second signal and generating said voltage with a third voltage level when said first signal indicates that said brake is applied and with a fourth voltage level when said second signal indicates that said tail light is to be present.

* * * * *